US006290073B1

(12) United States Patent
Barnes, Sr. et al.

(10) Patent No.: US 6,290,073 B1
(45) Date of Patent: Sep. 18, 2001

(54) FIREWOOD RACKS

(76) Inventors: Donny L. Barnes, Sr.; Eric V. Byrd, Sr., both of 31164 Hwy. 16, Denham Springs, LA (US) 70726

( * ) Notice: Subject to any disclaimer, the term of this patent is extended or adjusted under 35 U.S.C. 154(b) by 0 days.

(21) Appl. No.: 09/425,199

(22) Filed: Oct. 22, 1999

(51) Int. Cl.[7] ..... A47F 5/00

(52) U.S. Cl. ..... 211/60.1; 211/189; 211/175; 211/182; 248/165

(58) Field of Search ..... 211/189, 49.1, 211/60.1, 182, 175; 248/165

(56) References Cited

U.S. PATENT DOCUMENTS

| | | | | |
|---|---|---|---|---|
| D. 243,504 | * | 3/1977 | Morrison . | |
| D. 289,080 | * | 3/1987 | Einsel . | |
| D. 362,945 | * | 10/1995 | Glinski . | |
| 1,473,817 | * | 11/1923 | Gorsline | 211/182 X |
| 2,246,441 | | 6/1941 | Hurlbut . | |
| 2,801,752 | | 8/1957 | Jakubowski . | |
| 2,833,421 | | 5/1958 | Skubic . | |
| 2,962,170 | * | 11/1960 | Best | 211/182 |
| 2,984,363 | * | 5/1961 | Lang et al. | 211/182 |
| 3,021,011 | | 2/1962 | Visneski . | |
| 3,164,260 | * | 1/1965 | Seemann | 211/189 |
| 3,187,901 | * | 6/1965 | Wilson | 211/182 X |
| 3,724,678 | * | 4/1973 | Challier | 211/182 X |
| 4,039,264 | * | 8/1977 | Sharp | 211/182 X |
| 4,333,574 | | 6/1982 | Christy, Sr. . | |
| 5,743,413 | | 4/1998 | Noll . | |
| 5,820,092 | * | 10/1998 | Thaler | 211/189 X |
| 6,123,209 | * | 9/2000 | Tseng | 211/182 X |

FOREIGN PATENT DOCUMENTS

| | | | |
|---|---|---|---|
| 183985 | | 8/1922 | (GB) . |

* cited by examiner

*Primary Examiner*—Robert W. Gibson, Jr.
(74) *Attorney, Agent, or Firm*—Richard C. Litman

(57) ABSTRACT

A firewood rack kit which can be fabricated and taken apart without tools to double its load capacity from a one-quarter cord with an insert unit.

12 Claims, 3 Drawing Sheets

FIREWOOD RACKS

BACKGROUND OF THE INVENTION

1. Field of the Invention

The present invention relates generally to material holding racks. More specifically, the invention is a load supporting, modular, platform structure for firewood, which rack can be disassembled and reassembled without tools for two different load capacities.

2. Description of the Related Art

There is a need for a size convertible takedown firewood rack which can be conveniently sized for a one-fourth (32 cu. ft.) or a one-half cord (64 cu. ft.) load and require no tools for assembling or disassembling for either storage or changing the capacity.

The related art of interest describes various racks, but none discloses the toolless assembly and disassembly feature of the present invention. The art will be discussed in the order of perceived relevance to the present invention.

U.S. Pat. No. 2,833,421 issued on May 6, 1958, to Leroy F. Skubic describes a stacking rack capable of being several tiers high and having an infinite lateral length by assembling I frames and L frames made from rectangular metal construction. The I frame as the backbone of the rack comprises two vertical support posts which have two welded on cross arms and feet. The L frame is the lateral building block comprising a pair of horizontal load bearing bars and a pair of vertical load bearing legs which are joined by cross arms. Two L frames are arranged to flank an I frame by hooking a fixed ear or tang of a horizontal bar into a fixed C-shaped strap on a vertical post. Each post may have a metal cap. Planks for shelves or pallets are then placed across the horizontal bars. The stacking rack is distinguishable for neither suggesting nor teaching positively that both end posts can be taller than the central L frame posts.

U.S. Pat. No. 4,333,574 issued on Jun. 8, 1982, to R. Steven Christy, Sr. describes an outdoor wood rack having a hipped roof. The base frame, the two side frames and the hipped roof are bolted together. The rack can be made from wood (preferred), plastic or metal. The outdoor wood rack is distinguishable for its hipped roof and bolted structure.

U.S. Pat. No. 2,801,752 issued on Aug. 6, 1957, to Richard S. Jakubowski describes a modular metal stacking unit comprising four corner posts (square tubular) welded together to two end panels with longitudinal flanges, two inverted longitudinal floor channels, and truncated pyramidal caps on each post. The units are stacked to form a column and two separated columns can support bar stock. The stacking units are distinguishable for their welded structure.

U.S. Pat. No. 3,021,011 issued on Feb. 13, 1962, to Vern N. Visneski describes a firewood rack comprising two U-shaped tubular metal posts bolted down on a rectangular pan supported by a caster wheel assembly. The mobile rack is distinguishable for its rolling pan and fixed structure.

U.S. Pat. No. 5,743,413 issued on Apr. 28, 1998, to Ronald C. Noll describes an expandable shelf kit/log holder utilizing 2×4 lumber as base, tier and post members fastened by bolts and hexagonal nuts to universal brackets. Two inverted U-shaped metal tubes and tubular base member tubes can also be used. The log holder is distinguishable for its requirement for universal brackets and fasteners.

U.S. Pat. No. 2,246,441 issued on Jun. 17, 1941, to Newll G. Hurlbut describes a sectional support for floral displays comprising tubular stock made into an arch supported by two vertical posts, each having a plurality of spikes for hanging floral displays, a pivoting gate and four ground stabilizing bars which pivot up for storage. The sectional support is distinguishable for its specific purpose and structure.

G.B. Patent No. 183,985 issued on Aug. 10, 1922, to Arthur F. Jefferies describes a scaffold comprising upright steel pipes which can be tubular or have a crossed cross-section joined with horizontal channel steel by 4-way slotted cross piece connectors on the upright pipes and tapered keys on the ends of the horizontal channels. Bolted on collars on the upright pipes support the cross piece connectors. The scaffolding structure is distinguishable for its fixed structure and keyed connections.

None of the above inventions and patents, taken either singularly or in combination, is seen to describe the instant invention as claimed. Thus, firewood racks readily taken down when not in use or for changing its load capacity is desired.

SUMMARY OF THE INVENTION

The invention is a takedown firewood rack capable of doubling its load capacity, and made up of a pair of upright rack end elements, each element including a parallel pair of upright tubular posts with a square cross-section, joined by two short horizontal, square stock tubular crossbars, positioned proximate the top portion and the bottom portion. There is a socket positioned on each inside surface of each upright tubular post proximate the bottom portion, and a first pair of extended, square stock horizontal tubular crossbars having end plates positioned vertically downward at each end, frictionally fitting in each socket to join the pair of upright rack end elements.

Accordingly, it is a principal object of the invention to provide a takedown firewood rack with two different load capacities which require no tools for assembly or disassembly.

It is another object of the invention to provide a takedown firewood rack with a capacity of one-fourth cord capability.

It is a further object of the invention to provide a takedown firewood rack with a capacity of one-half cord capability.

Still another object of the invention is to provide a takedown firewood rack with an insert to double the capacity of the one-fourth cord holding rack.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
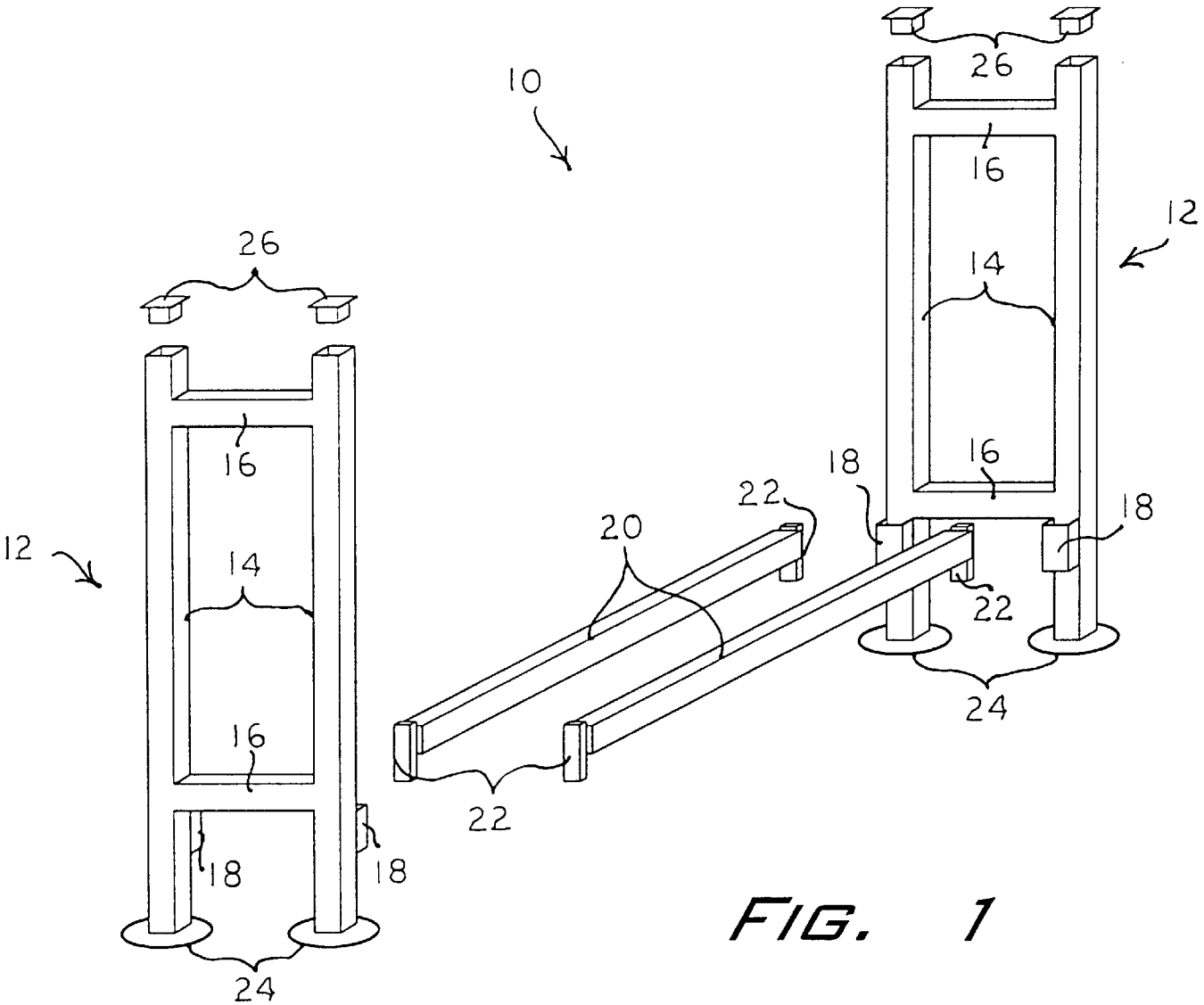
FIG. 1 is a perspective view of a takedown firewood rack having a capacity load of one-quarter cord according to the present invention.

The present invention is directed to a versatile, economical and readily installable takedown firewood rack which can be doubled in capacity from a one-quarter cord size. In FIG. 1, a takedown firewood rack 10 capable of doubling its load capacity comprises a pair of upright rack end elements 12. Each rack end element 12 comprises a parallel pair of upright tubular posts 14 with a square cross-section joined by two short horizontal tubular crossbars 16 with a square cross-section positioned proximate the top portion and the bottom portion of the posts 14.

A socket 18 is positioned on each inside surface of each upright tubular post 14 proximate its bottom portion. A first pair of extended horizontal tubular crossbars 20 having a square cross-section and end plates 22 positioned vertically downward at each end and adapted to frictionally fit in each socket 18 to join the pair of upright rack end elements 12.

A pair of disc-shaped foot plates 24 is provided for the bottom end of each upright rack end element 12. A pair of plastic caps 26 is provided for the top end of each upright rack end element 12.

The rack 10 of FIG. 1 will hold at least ¼ cord of firewood. Each tubular rack end element 12, socket 18 and crossbar 16 is made of metal and dip-coated with paint.

Figure 2:
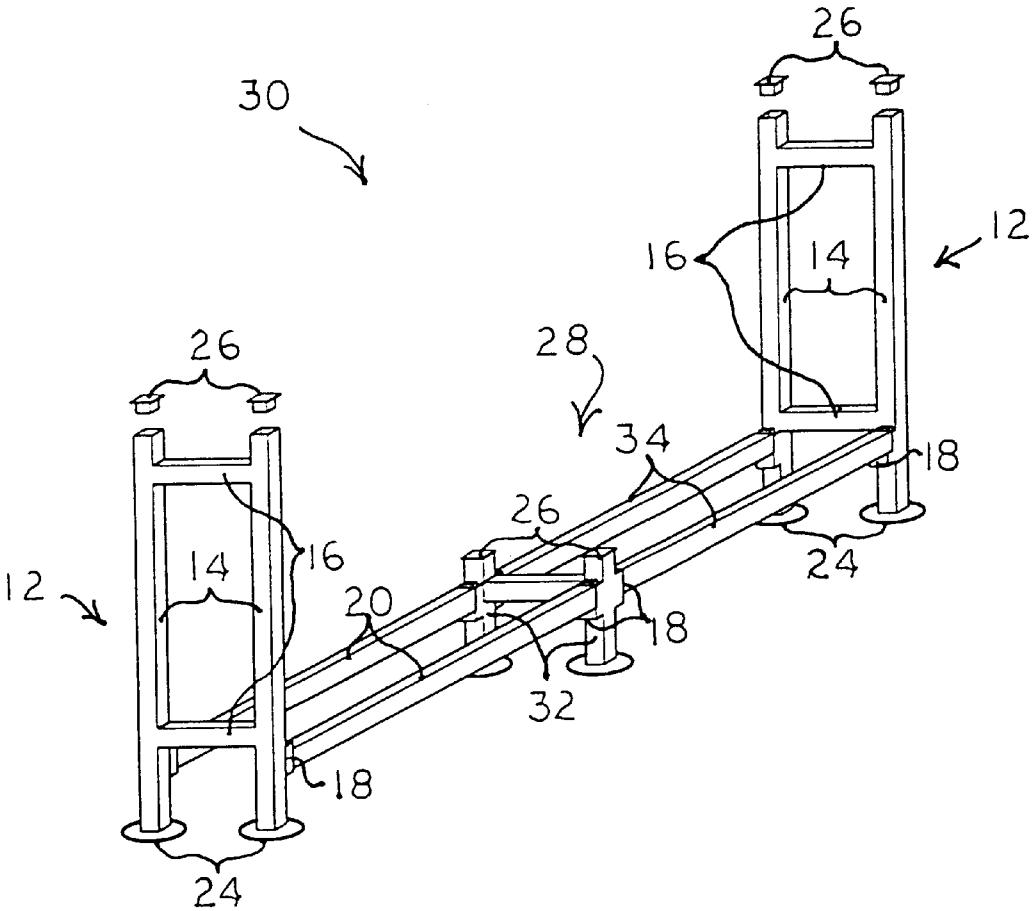
FIG. 2 is a perspective view of a takedown firewood rack having a capacity load of one-half cord according to the present invention.
Figure 3:
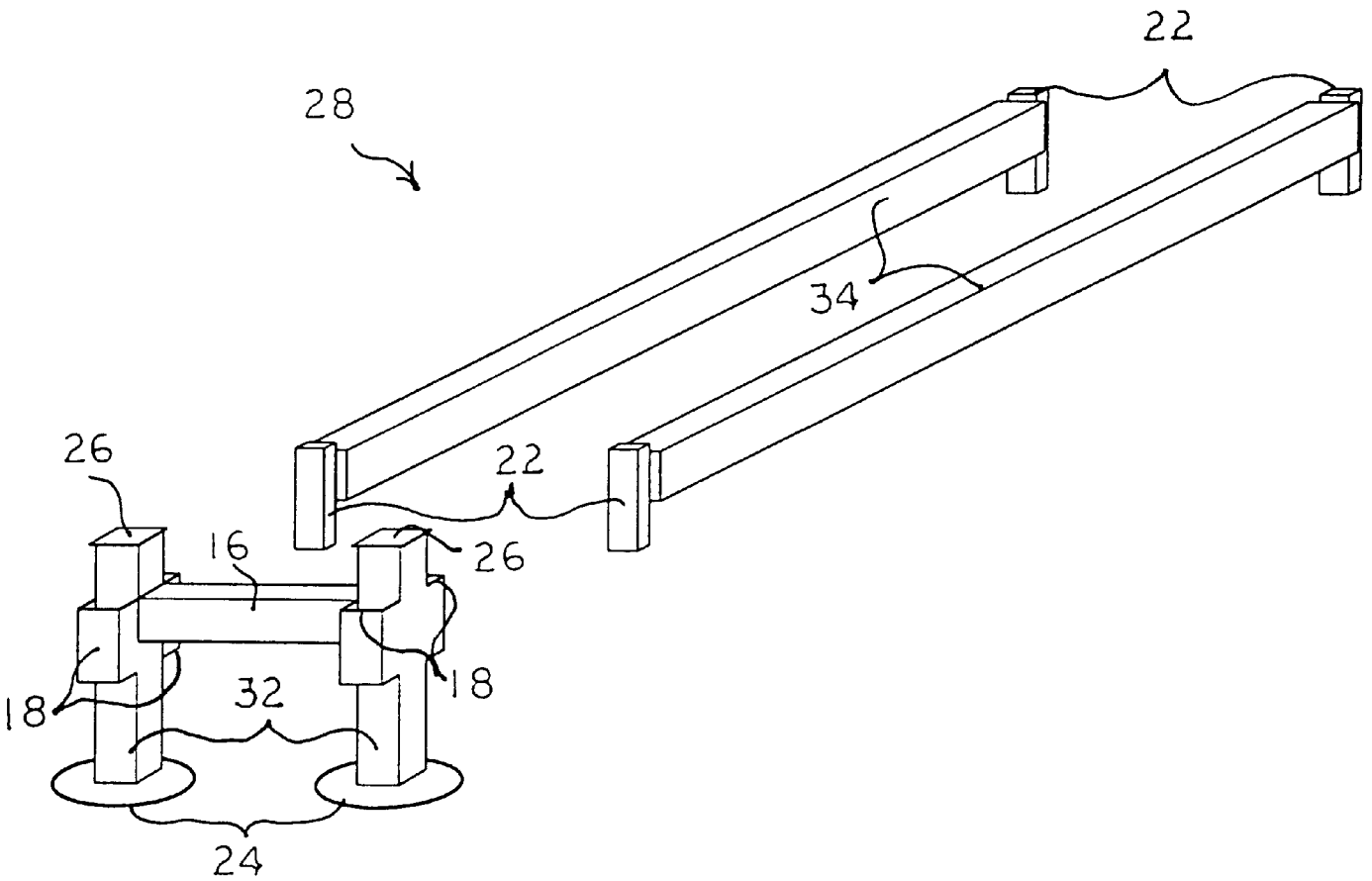
FIG. 3 is a perspective view of an insert for doubling the capacity of the one-quarter cord size rack.

An accessory unit 28 for doubling the capacity of the rack 10 is illustrated in FIG. 3 and forming the extended rack 30 in FIG. 2 as comprising a pair of short upright intermediate rack elements 32 with a square cross-section joined by a short horizontal tubular crossbar 34 with a square cross-section and having sockets 18 on each opposite side of each intermediate rack element 32. A pair of disc-shaped foot plates 24 is provided for each upright intermediate rack element 32. A second pair of extended horizontal tubular crossbars 34 having a square cross-section and end plates 22 positioned vertically downward at each end is adapted to frictionally fit in each said socket 18 to join the pair of upright rack end elements 12.

An exemplary list of materials utilized in the present invention with dimensions is provided as follows with all the square tubes 2 in.×2 in. and 16 gauge steel.

14 upright tubular posts, 3 ft. 8 in. to 5 ft.

16 horizontal crossbars, 1 ft.

18 sockets, 2 in. length, 1 in. width, 3 in. deep, 3/16 in. thick.

20 first and second pairs of extended horizontal crossbars, 4 ft. 1.5 in.

22 end plates, 5 in. length, 1.5 in. width.

24 disc-shaped foot plates, approximately 4 to 6 in. diameter.

32 intermediate rack element posts, 11.5 in. height.

It is to be understood that the present invention is not limited to the embodiments described above, but encompasses any and all embodiments within the scope of the following claims.

What is claimed is:

1. A takedown firewood rack capable of doubling its load capacity comprising:

a pair of upright rack end elements, each element comprising a parallel pair of upright tubular posts with a square cross-section joined by two short horizontal tubular crossbars with a square cross-section positioned proximate the top portion and the bottom portion;

a socket positioned on each inside surface of each upright tubular post proximate the bottom portion;

a first pair of extended horizontal tubular crossbars having a square cross-section and end plates positioned vertically downward at each end and adapted to frictionally fit in each said socket to join the pair of upright rack end elements;

an accessory unit for doubling the capacity of the rack, said accessory unit including:

a pair of short upright intermediate rack elements with a square cross-section joined by a short horizontal tubular crossbar with a square cross-section and having sockets on each opposite side of each intermediate rack element; and a second pair of extended horizontal tubular crossbars having a square cross-section and end plates positioned vertically downward at each end and adapted to frictionally fit in each said socket to loin the pair of upright rack end elements.

2. The takedown firewood rack according to claim 1, including a pair of disc-shaped foot plates for each upright rack end element.

3. The takedown firewood rack according to claim 1, including a pair of plastic caps for each upright rack end element.

4. The takedown firewood rack according to claim 1, including a pair of disc-shaped foot plates for each upright intermediate rack element.

5. The takedown firewood rack according to claim 1, including a pair of plastic caps for each upright intermediate rack element.

6. The takedown firewood rack according to claim 1, wherein the extended rack is dimensioned and configured to hold at least ½ cord of firewood.

7. The takedown firewood rack according to claim 1, wherein each intermediate rack element, socket and crossbar is made of metal and dip-coated with paint.

8. An accessory unit for doubling the capacity of a firewood rack having a pair of upright rack end elements, said accessory unit comprising:

a pair of short upright intermediate rack elements with a square cross-section joined by a short horizontal tubular crossbar with a square cross-section and having sockets on each opposite side of each intermediate rack element; and a pair of extended horizontal tubular crossbars having a square cross-section and end plates positioned vertically downward at each end and adapted to frictionally fit in each said socket to join the pair of upright rack end elements of the firewood rack.

9. The accessory unit according to claim 8, including a pair of disc-shaped foot plates for each upright intermediate rack element.

10. The accessory unit according to claim 8, including a pair of plastic caps for each upright intermediate rack element.

11. The accessory unit according to claim 8, wherein the capacity of the firewood rack is doubled to hold at least ½ cord of firewood.

12. The accessory unit according to claim 8, wherein each intermediate rack element, socket and crossbar is made of metal and dip-coated with paint.

* * * * *